US005342040A

United States Patent [19]

Markgraf

[11] Patent Number: 5,342,040

[45] Date of Patent: Aug. 30, 1994

[54] TURNING DEVICE FOR SHEETS OF PAPER IN A FEED WEB

[75] Inventor: Wilhelm Markgraf, Tennenbronn, Fed. Rep. of Germany

[73] Assignee: Mathias Bauerle GmbH, St. Georgen, Fed. Rep. of Germany

[21] Appl. No.: 93,098

[22] Filed: Jul. 16, 1993

[30] Foreign Application Priority Data

Jul. 17, 1992 [DE] Fed. Rep. of Germany ... 9209615[U]

[51] Int. Cl.[5] ..... B65H 9/16

[52] U.S. Cl. ..... 271/251; 271/184; 198/415

[58] Field of Search ..... 271/229, 250, 251, 184, 271/185, 272; 198/415

[56] References Cited

U.S. PATENT DOCUMENTS

| | | | |
|---|---|---|---|
| 1,973,749 | 9/1934 | Dawson | 271/251 |
| 2,190,416 | 2/1940 | Davidson | 271/251 |
| 2,190,418 | 2/1940 | Davidson et al. | 271/251 |
| 4,438,918 | 3/1984 | Ito et al. | 271/251 |
| 4,955,965 | 9/1990 | Mandel | 271/251 |
| 5,056,772 | 10/1991 | Kellum | 271/184 |
| 5,114,137 | 5/1992 | Olson | 271/251 |
| 5,224,696 | 7/1993 | Kellum | 271/251 |

FOREIGN PATENT DOCUMENTS

| | | | |
|---|---|---|---|
| 0244847 | 10/1987 | Japan | 271/185 |

*Primary Examiner*—H. Grant Skaggs
*Attorney, Agent, or Firm*—McGlew & Tuttle

[57] ABSTRACT

The present invention provides a device that makes possible to turn individual sheets of paper 3 by an angle of 90° during their transport without a change in their direction of feed, arrow 8, even at high speeds of feed. In the device according to the present invention, a stopping roller 22 with a pressure ball 33, is driven opposite to the direction of feed, arrow 8 and is arranged directly in front of the taut side 23' of a conveyor belt 23 in the direction of feed, arrow 8. A longitudinal row of pressure balls 22–29 are in contact with the conveyor belt 23. A drive roller 34 is driven in the direction of feed, arrow 8, and is provided with a pressure ball 35 in contact with a higher contact pressure than the pressure ball 33 to the stopping 22. The driver roller 34 arranged laterally offset from the feed web center 38 and directly in front of the roller stopping roller 22.

13 Claims, 2 Drawing Sheets

TURNING DEVICE FOR SHEETS OF PAPER IN A FEED WEB

FIELD OF THE INVENTION

The present invention pertains to a device for rotating sheets of paper by an angle of preferably 90° in a web, which has feed means located in a horizontal plane in the form of rollers or endless conveyor belts and sliding strips, as well as guide rail on the long side. The present invention includes pressure balls which are mounted loosely rotatable in cylindrical ball cages, and are in contact with the feed means for the frictionally engaged pressing of the sheets of paper onto the feed means.

It frequently happens during the processing of sheets of paper in various processing machines that the sheets of paper leave one machine, e.g., in broadside format, and are to be fed into processing machine in upright format. It is therefore necessary to turn the sheets of paper being transported from one machine into the next by 90°, from the broadside format into the upright format or vice versa between two processing machines.

It frequently happens in prior-art feed mechanisms for sheets of paper that the sheets of paper run in broadside format on a feed mechanism against a stop rail and are then transported from there to the next machine in the longitudinal direction of the said stop rail, i.e., at right angles to the previous direction of feed, so that the sheets will then assume the upright format.

SUMMARY AND OBJECTS OF THE INVENTION

The basic object of the present invention is to provide the simplest device possible of this class, with which it is possible to turn the individual sheets of paper by an angle of 90° during their transportation from one machine to the second machine without changing the direction of feed. This turning is to take place even at high speeds of feed, without damage to the sheets of paper, especially to the leading edges of the sheets of paper.

This object is accomplished according to the present invention such that a first means feeds the sheet in a first orientation in the feed direction. A drive roller is positioned downstream of the first feed means and usually on the bottom side of the sheet. The drive roller has a rotating surface that comes in contact with one side of the sheet and this rotating surface moves in the feed direction. A drive pressure ball is positioned on the other side of the sheet and biased against the sheet and the rotating surface of the drive roller. A stopping roller is positioned downstream of the drive roller and is spaced from the drive roller in a lateral direction perpendicular to the feed direction and in the plane of the sheet. The stopping roller also has a stopping pressure ball similar to the drive pressure ball but biased against the stopping roller with a force that is less than the drive pressure ball is biased against the drive roller. In one embodiment, the rotating surface of the stopping roller moves in a direction substantially opposite to the feed direction. A second feed means is positioned downstream of the stopping roller and feeds the sheet in a second orientation in the feed direction. The second feed means preferably includes a conveyor directly downstream of the stopping roller and plurality of pressure balls pressing the sheet against the conveyor. This conveyor and the pressure balls are preferably positioned along a lateral edge of the sheet in the second orientation.

Not only are all the conditions of the above-described task met with such a device, but the individual sheets of paper are turned with very simple, reliably functioning means and measures, which guarantee their desired reliability of operation extensively independently from the grade of the paper.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
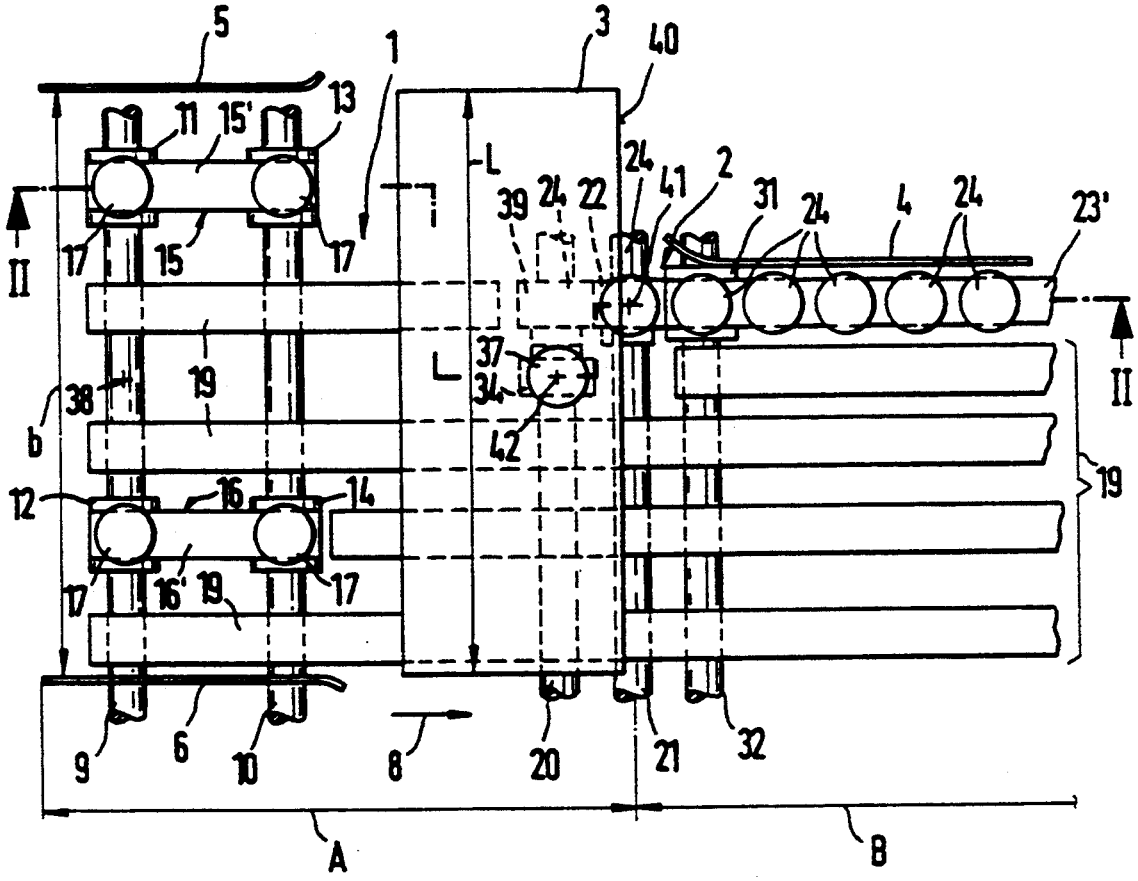
FIG. 1 shows the top view of a feed web with a device for turning individual sheets of paper by 90°.

The device shown in the drawing is a feed web 1 located in a horizontal plane with a sheet-turning station 2, by which sheets of paper 3 arriving in a broadside format are turned by 90° and are further transported in upright format along a guide rail 4. The sheets of paper 3 arriving in broadside format first run through a feed web section A, which is limited laterally by two guide rails 5 and 6, and then in the upright format through a feed web section B, which directly joins the sheet-turning station 2. The distance b between the guide rails 5, 6 corresponds approximately to the length L of the sheet of paper 3. Two belt rollers 11 and 12 as well as 13 and 14, which are arranged at spaced locations from and symmetrically to the feed web center 38, are located in the feed web section A in front of the sheet-turning station 2 on two shafts 9 and 10. The two shafts 9 and 10 extend at right angles to the direction of feed indicated by the arrow 8, and endless conveyor belts 15 and 16, respectively, whose respective upper, taut sides 15' and 16' are driven in the direction of feed indicated by the arrow 8, run over the belt rollers 11 and 12 as well as 13 and 14. Pressure balls 18 are arranged freely rotatable in stationary guide cages 17 and maintain the sheet of paper 3 passing through under them in frictionally engaged contact with the conveyor belts 15 and 16. The pressure balls 18 can be in contact with the taut sides 15', 16' of the conveyor belts 15 and 16. A plurality of sliding strips 19, which preferably consist of sheet metal, are arranged between and beside the conveyor belts 15 and 16.

Figure 2:
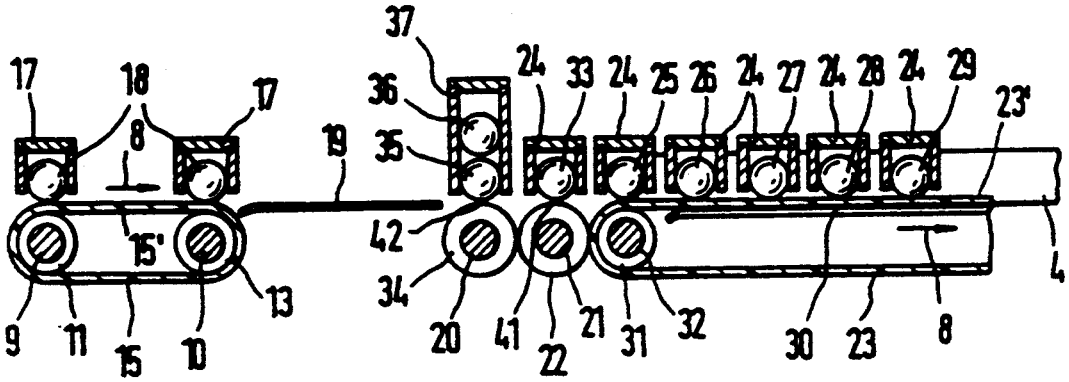
FIG. 2 shows a section II—II from FIG. 1.

The turning station 2 arranged at the end of the feed web section A is provided with two shafts, which are arranged directly next to one another, extend in parallel to one another, and are driven in opposite directions in relation to one another; namely, with a drive shaft 20, which rotates in the forward direction, i.e., in the same direction as the shafts 9 and 10, and with a stopping shaft 21, which rotates in the opposite direction thereto, i.e., in the reverse direction. A stopping roller has a friction jacket 44 made of rubber or the like and is arranged directly in front of the conveyor belt 23. The stopping roller extends along the guide rail 4 and is rigidly arranged on the stopping shaft 21. A plurality of pressure balls 25, 26, 27, 28, and 29 are in loose contact, under their own weight, with the upper, taut side 23' of the conveyor belt 23, and the pressure balls 25, 26, 27, 28, and 29 are mounted freely rotatably in stationary ball cages 24. The upper, taut side 23' is supported by a support strip 30. The upper, taut side 23' has the same direction of feed, indicated by the arrow 8, as the taut sides 15' and 16' of the conveyor belts 15 and 16. The conveyor belt 23 is led over a belt roller 31, which is mounted on a shaft 32 and rotates in the same direction as the belt rollers 11 through 14, which rotate clockwise in relation to FIG. 2. In contrast, the so-called stopping roller 22 with the stopping shaft 21 rotates counterclockwise, i.e., opposite the direction of feed. A pressure ball 33, which is guided in a ball cage 24 and has a smooth surface, is in loose contact with the stopping roller 22. The contact pressure of the pressure ball 33 is able to prevent an edge 40 of a sheet of paper arriving at the contact point 41 between the pressure ball 33 and the jacket surface of the stopping roller 22 from passing through, without the edge being damaged in any way. To generate the necessary braking effect even in the case of thin sheets of paper, the pressure ball 33 is made of a material of high specific gravity, e.g., steel. A drive roller 34, which is driven clockwise in relation to FIG. 2, like the belt rollers 11 through 14 and 31, i.e., in the direction of feed, is nonrotatably or fixedly arranged on the drive shaft 20 in the feed web center 38, from which the conveyor belt 23, the guide rail 4, as well as the stopping roller 22 are located only at a short distance laterally. A pressure ball 35, with which a second pressure ball 36 is in contact, is in contact with the drive roller 34. Both pressure balls 35 and 36 are arranged loosely rotatably in a higher ball cage 37, and both consist of steel, so that the lower pressure ball 35 is in contact with the jacket surface 44 of the turning roller 34 with a contact pressure that is approximately double the contact pressure with which the pressure ball 33 is in contact with the stopping roller 22.

Figure 3:
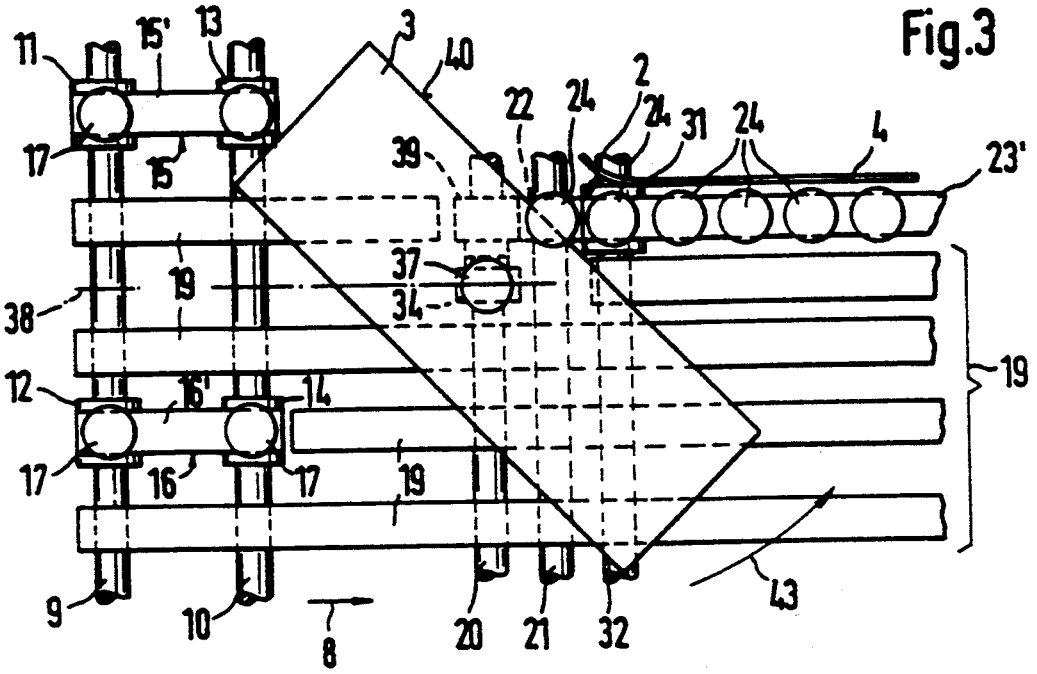
FIG. 3 shows the device according to FIG. 1 with a partially turned sheet of paper.
Figure 4:
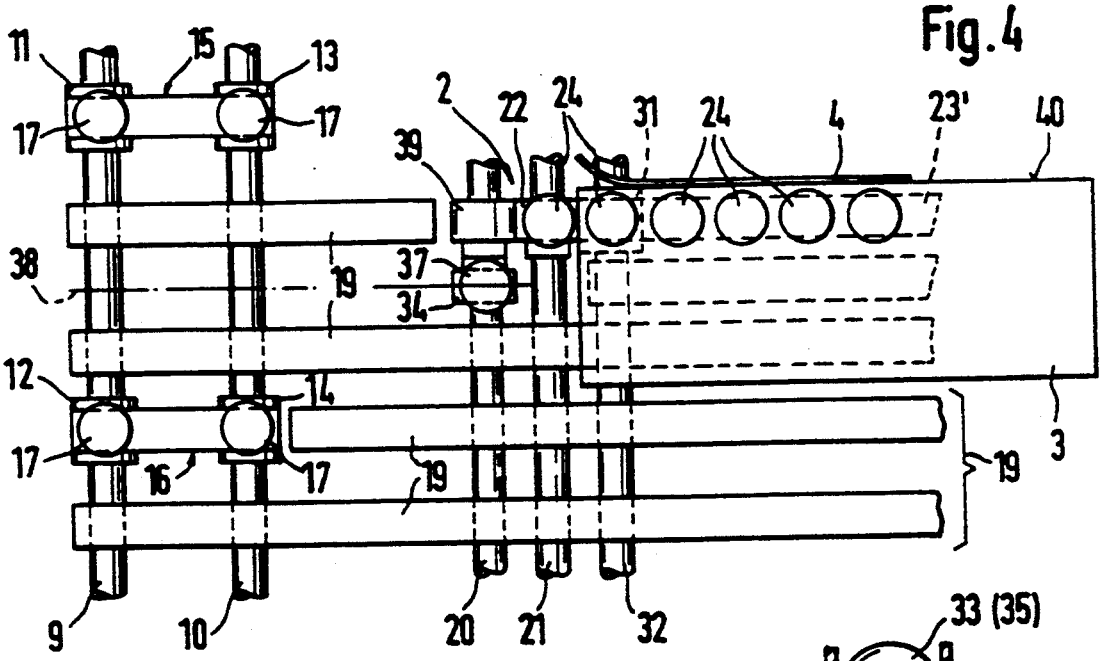
FIG. 4 shows the same device as FIG. 1, with a completely turned sheet of paper.

The present invention operates due to the lateral offset, shown in the FIGS. 1, 3 and 4, of the drive roller 34 in relation to the stopping roller 22, which is arranged aligned with the conveyor belt 23, and due to the different friction conditions and different contact pressures acting on the stopping roller 22, on the one hand, and on the drive roller 34, on the other hand, as follows:

A sheet of paper, which arrives with, e.g., its front traverse edge 40 at the contact point 41 pressure ball 33 and the stopping roller 22, is first stopped at the contact point 41. However, further feed is brought about at the same time by the drive roller 34, whose contact point 42 with the pressure ball 35 had already been passed through by the front edge 40 of the sheet of paper 3. As a consequence of which the sheet performs a turning movement according to FIG. 3 around the contact point 41. The front edge 40 of the sheet of paper 3 is pushed into the contact point 41 approximately after turning by somewhat more than 45°. As a consequence of the roller 22 rotating in the opposite direction, the sheet of paper 3 is moved backward against the normal direction of rotation. As a result, the sheet of paper 3 is turned more widely in the direction of the arrow 43, until the original front edge 40 will finally completely to lie against the guide rail 4, as is shown in FIG. 4, and the sheet of paper 3 is transported in the longitudinal direction by the conveyor belt 23 moving belt 23 moving in the normal direction of feed according to the arrow 8 to the next processing machine, not shown, or to a stacking means.

It is also important in the turning station 2 for the stopping roller 22 and the drive roller 34 to have a lower circumferential speed than the belt rollers 11 through 13 and 31. The circumferential speed of the stopping roller 22 and of the drive roller 34 is optimally approximately half the speed of feed of the conveyor belts 15, 16 and 23, or the circumferential speed of the belt rollers 11 through 14 and 31.

It is also advantageous for at least the first two or three of the pressure balls, 25, 26, and 27 of the conveyor belt 23 to consist of plastic, i.e., for the pressure balls to be in contact with the taut side 23' of the conveyor belt 23 with a relatively low contact pressure, so that the original front edge 40 of the sheet of paper 3 can be pushed under it more easily without being damaged. On the whole, the pressure balls 25 through 29, which are in contact with the taut side 23' of the conveyor belt 23, may be lighter, because a plurality of them are present and thus they are nevertheless able to guarantee the necessary frictional connection between the sheet of paper 3 and the conveyor belt 23.

To counteract the tendency of the front edge 40 of the sheet of paper 3 from moving away from the contact point 41, between the pressure ball 33 and the belt roller 22, in the rearward direction during the turning of the sheet of paper 3, a second drive roller 39 is arranged on the drive shaft 20 directly in front of the stopping roller 22. The drive roller 39 is provided with a friction jacket, and the sheet of paper 3 is in loose contact with it, but it comes into such a strong frictional connection with the underside of the sheet of paper 3 that it continually pushes the sheet of paper against the contact point 41.

It is also advantageous for the stopping roller 22 with its pressure ball 33 to be offset laterally to the plane of the guide rail 4 in relation to the drive roller arranged in the feed web center 38 by an amount that corresponds approximately to one fourth of the width or the length L of the arriving transverse edge 40 of the turning sheet of paper 3 or of the feed web width b.

Figure 5:
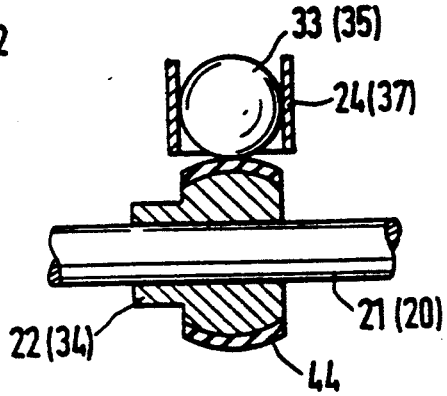
FIG. 5 shows a sectional view of the stopping or drive roller.

It may be advantageous for the drive roller 34 to be arranged displaceably on the drive shaft 20. It is also advantageous to provide the stopping roller 22 and/or the drive roller 34 with a crowned jacket surface 44, as is shown in FIG. 5, so that small, circular contact surfaces, rather than linear contacts, can form between the sheet of paper 3 and the jacket surfaces. This facilitates the turning process.

Experience has shown that the contact pressures with which the respective pressure balls 33 and 35 are in contact with the jacket surfaces of the respective associated stopping roller 22 and drive roller 34 may depend on the grade of the paper, smooth paper requiring a higher contact pressure than a relatively rough paper.

What is claimed is:

1. A device for turning a sheet, the device comprising:

first feed means for feeding the sheet in a first orientation and in a feed direction;

a drive roller positioned downstream of said first feed means and on one side of the sheet, said drive roller having a rotating surface positioned adjacent the one side of the sheet and moving in said feed direction;

a drive pressure ball positioned on another side of the sheet opposite said one side, said drive pressure ball is biased against the sheet and said rotating surface of said drive roller;

a stopping roller positioned downstream of said drive roller on the one side of the sheet and spaced from said drive roller in a lateral direction perpendicular to said feed direction, said stopping roller having a rotating surface positioned adjacent the one side of the sheet;

a stopping pressure ball positioned on the another side of the sheet, said stopping pressure ball is biased against the sheet and said rotating surface of said stopping roller with a force less than a force of said drive pressure ball biased against the sheet;

second feed means positioned downstream of said stopping roller and for feeding the sheet in a second orientation and in said feed direction.

2. A device in accordance with claim 1, wherein:

said second feed means includes a conveyor substantially directly downstream of said stopping roller and positioned on the one side of the sheet, said second feed means also including a plurality of pressure balls positioned on the another side of the sheet and biased against the sheet and said conveyor.

3. A device in accordance with claim 2, wherein:

a first two upstream pressure balls of said plurality of pressure balls of said second feed means are formed of plastic;

said stopping pressure ball and said drive pressure ball are formed of steel.

4. A device in accordance with claim 1, wherein:

said second feed means includes a longitudinal guide rail extending in said feed direction and positioned on a lateral side of the sheet in said second orientation, said conveyor being positioned adjacent said longitudinal guide rail.

5. A device in accordance with claim 1, wherein:

said rotating surface of said stopping roller and said drive roller move with a speed less than a speed said first and second feed means move the sheet in said feed direction.

6. A device in accordance with claim 5, wherein:

said speed of said rotating surface of said stopping and drive rollers is approximately half of said speed of said sheet moved by said first and second feed means.

7. A device in accordance with claim 1, wherein:

said rotating surface of said stopping roller moves in a direction substantially opposite from said feed direction.

8. A device in accordance with claim 1, wherein:

a first two upstream pressure balls of said plurality of pressure balls of said second feed means are biased against the sheet with a force less than said force of said stopping pressure ball against the sheet.

9. A device in accordance with claim 8, wherein:

said force of said first two upstream pressure balls of said plurality of pressure balls of said second feed means is approximately half of said force of said stopping pressure ball against the sheet.

10. A device in accordance with claim 1, further comprising:

another drive roller positioned substantially coaxially with said drive roller and substantially directly upstream of said stopping roller, said another roller being of substantially equal size with said drive roller.

11. A device in accordance with claim 1, wherein:

said second feed means includes a longitudinal guide rail extending in said feed direction and positioned on a lateral side of the sheet in said second orientation;

said drive roller is positioned substantially along longitudinal center of said first feed means;

said stopping roller is laterally positioned between said drive roller and said longitudinal guide rail, and laterally spaced from said drive roller.

12. A device in accordance with claim 1, wherein:

said stopping roller and said drive roller each have a friction jacket.

13. A device in accordance with claim 1, wherein:

said stopping roller and said drive roller each have a crowned jacket surface.

* * * * *